United States Patent [19]

Diener et al.

[11] Patent Number: 4,725,385

[45] Date of Patent: Feb. 16, 1988

[54] TURBINE ROTOR ASSEMBLY FOR A ROTOR-TYPE CARBURETOR

[75] Inventors: Rudolf Diener, Zurich, Switzerland; Elbert M. Hubbard, Dallas, Tex.

[73] Assignee: Kwik Products International Corporation, Portland, Oreg.

[21] Appl. No.: 899,666

[22] Filed: Aug. 22, 1986

Related U.S. Application Data

[63] Continuation-in-part of Ser. No. 877,445, Jun. 30, 1986.

[51] Int. Cl.[4] ..... F02M 17/16

[52] U.S. Cl. ..... 261/88; 261/89

[58] Field of Search ..... 261/88, 89

[56] References Cited

U.S. PATENT DOCUMENTS

| | | | |
|---|---|---|---|
| 2,668,698 | 2/1954 | Rollins | 261/88 |
| 3,829,071 | 8/1974 | Valbona et al. | 261/89 |
| 3,991,144 | 11/1976 | Diener | 261/36.2 |
| 4,106,453 | 8/1978 | Burley | 261/44.3 |
| 4,196,264 | 4/1980 | Troedsson et al. | 429/114 |
| 4,283,358 | 8/1981 | Diener | 261/88 |
| 4,369,149 | 1/1983 | Violett | 261/44.2 |
| 4,474,712 | 10/1984 | Diener | 261/89 |
| 4,503,003 | 3/1985 | Gilbert | 261/88 |
| 4,522,766 | 6/1985 | Sunada | 261/91 |

*Primary Examiner*—Tim Miles

*Attorney, Agent, or Firm*—Hubbard, Thurman, Turner & Tucker

[57] ABSTRACT

An injection molded plastic turbine rotor for a rotor-type carburetor is assembled by simply pressing together upper and lower generally cylindrical sections. When joined in this manner the two sections form in the assembled rotor an internal circumferential seal between the two sections, and an internal passageway system which defines a centrifugal pump mechanism within the turbine rotor. In an alternate embodiment, the rotor includes a third plastic section which is captively retained within the rotor, between the upper and lower sections thereof, and is adapted to lockingly receive an end portion of a fuel supply tube inserted downwardly through a central opening formed through the upper section.

33 Claims, 10 Drawing Figures

TURBINE ROTOR ASSEMBLY FOR A ROTOR-TYPE CARBURETOR

CROSS-REFERENCE TO RELATED APPLICATIONS

This application is a continuation-in-part of U.S. application Ser. No. 877,445 filed June 30, 1986 and entitled "Fuel-Air Ratio (λ)-Correcting Apparatus for a Rotary-Type Carburetor for Internal Combustion Engines".

BACKGROUND OF THE INVENTION

The present invention relates generally to rotor-type carburetors utilized in internal combustion engines, and more particularly provides an improved turbine rotor assembly for use in this type of carburetor, and associated construction methods for the improved rotor assembly.

The rotor-type carburetor, also referred to as a "central injection device", has been proposed, in various versions thereof, as a replacement for the conventional carburetor in a variety of internal combustion spark ignition engines because of its very advantageous provision of an essentially constant fuel-air ratio (λ) over all operating speeds of the engine. Examples of these devices are disclosed in U.S. Pat. Nos. 3,991,144, 4,283,358, and 4,474,712. In its basic operating format, the rotor-type carburetor is provided with a bladed turbine rotor section which is coaxially and rotationally disposed in the air intake passage of the engine upstream of the butterfly damper therein. During operation of the engine, ambient air drawn inwardly through the engine's air intake passage causes rapid rotation of the bladed rotor section. A centrifugal pumping mechanism formed within the rotor draws fuel from a source thereof into the rotor and forces the received fuel outwardly through the rotor, via at least one lateral fuel discharge bore, onto and across a coaxially carried atomization ring into the ingested air stream. Importantly, the quantity of finely atomized fuel entering the air stream is in an essentially constant ratio to the ingested quantity of air, thereby essentially eliminating the fuel-air ratio variation problems commonly encountered in conventional carburetors.

While previously proposed rotor-type carburetors have proven to be quite effective in providing this very desirable constant fuel-air ratio benefit, it is now seen as desirable to improve various structural aspects of, and assembly techniques for, this type of carburetor. For example, the turbine rotor section of this type of carburetor has heretofore been relatively complex (and thereby relatively costly) to fabricate and assemble. This relative complexity and costliness of the turbine rotor section has previously arisen due primarily to the concomitant requirements that the rotor section be of at least relatively light-weight construction, have a high degree of dimensional precision (particularly with regard to the internal passageways defining the centrifugal pump portion of the rotor), and provide effective sealing between its various components, and particularly with respect to the seal between the stationery fuel line and the rotating rotor.

To meet these important design criteria, previously proposed turbine rotor structures have been of essentially all-metal construction (at least as to the central hub portion thereof) in which a relatively large number of metal parts must be precisely fabricated and accurately assembled. This results in relatively high mass, which causes lags in changing the rotational speed of the rotor in response to changes in the volumn of air flow.

Since, after the engine is turned off, this residual centrifugal pumping action is neither necessary nor particularly desirable, it can be seen that it would be advantageous to provide a mechanism for automatically decreasing the spin-down time of the turbine rotor section, to make changes in the speed of the rotor more closely follow changes in the volumn of air flow.

As mentioned above, the typical turbine rotor section has a laterally disposed internal orifice through which fuel is discharged for ultimate dispersal into the ingested air stream as a fine mist or "fog". Such orifice, of necessity, is disposed above the float-maintained fuel level in the engine's float reservoir. This height differential between the orifice and the maintained upper level of the fuel creates a siphon-breaking air gap upon engine shutdown to prevent outward siphoning of fuel through the orifice after the engine has been stopped. While this is, of course, a necessary and very desirable feature it also means that during engine startup fuel must be centrifugally pumped upwardly into this air gap to fill it, to provide the necessary fuel outflow through the orifice. This results in at least a slight delay between the initiation of turbine spin up and the required outflow of fuel through the orifice. It can thus be seen that it would be quite desirable to eliminate or at least substantially reduce this fuel delivery delay.

Several other problems or limitations have been commonly associated with the turbine rotor assemblies of the central injection carburation devices discussed above. For example, because it is desirable for the turbine section to operate with minimum friction, it has been desirable to provide a hydrostatic seal which operates without sliding contact with other structural members, the turbine spin-down time after air flow is stopped by throttle action is relatively long. Of course, during such spin-down condition, the centrifugal fuel-pumping action of the turbine rotor assembly, to at least a limited extent, is operative until the rotation of the turbine rotor ceases.

Finally, because of the relatively high number of parts required to fabricate previously proposed turbine rotor sections, a concomitantly high number of internal sealing mechanisms must also be provided to prevent undesired fuel flow past various interfacing portios of such parts. This heretofore unavoidable sealing complexity adds to the cost of fabricating and assembling the turbine rotor section, and also can potentially adversely affect its reliability and operating efficiency.

Accordingly, it is an object of the present invention to provide an improved turbine rotor structure, and associated assembly methods therefor, which eliminates or minimizes above-mentioned and other problems and limitations associated with previously proposed turbine rotor sections of rotor type carburetors.

SUMMARY OF THE INVENTION

In carrying out principles of the present invention, in accordance with a preferred embodiment thereof, an improved, and significantly simplified, turbine rotor assembly is rotatable mounted in a barrel on lower and upper spyders by lower and upper bearing means. A fixed fuel inlet tube extends downwardly along the axis of rotation into rotor assembly. The rotor assembly is conveniently formed from two generally cylindrical injection molded plastic sections -an upper section and a lower section. The two sections are simply pressed together to form the bladed turbine rotor in which the facing surfaces form an internal fluid chamber or passageway which defines the rotor's centrifugal fuel pump portion, as well as other desired features to produce a functioning device. A single circumferential seal between the two plastic sections with the rotor body is all that is then required to form a high pressure chamber within the turbine from which fuel can be metered through a restrictive orifice formed in one of the sections to provide the correct fuel dosage.

The upper section, which has the turbine blades molded integrally therewith, has a metal fuel spray ring press-fitted onto a lower end portion thereof, while an upper end portion of the second section may conveniently carry the seal-forming means and the fuel outlet orifice. The upper section also has an axially extending central opening formed therethrough and receive a downwardly extending fuel supply tube from the upper spyder support. This construction particularly permits a combination sliding seal and stabilizing bearing.

In another important embodiment of the present invention, an enhanced hydrostatic seal is provided by a third injection-molded plastic section fixed on the fuel inlet tube between the upper and lower sections thereof immediately adjacent the lower end of the central axial opening extending into the upper rotor section. This third section causes the fuel to first flow radially outwardly so that the fuel will not return to the axial space between the upper section and the fuel inlet tube as long as the rotor is rotating. To assemble the rotor, the third section is simply placed on the bottom of a central axial recess formed in the lower rotor section. The upper and lower rotor sections are then pressed together as previously described. Next, the upper rotor section is pressed upwardly onto the downwardly extending fuel tube so that the fuel tube is forced into the central axial opening of the upper section. During this final phase of the assembly, the lower end of the fuel tube is pushed into the central axial opening of the third rotor section into a press-fit engagement therewith. In the assembled turbine rotor, this internal third section defines with the upper and lower sections an internal, generally frustoconically-shaped passage which functions to provide, adjacent the bottom of the rotor assembly, a fuel-filled "trap" which impedes the entry of air into the rotor interior during turbine startup, and provides a centrifugal pump which establishes a pressure hold preventing fuel from passing upwardly whenever the rotor is rotating, and a liquid trap which prevents air from entering the system while the rotor is at rest.

According to other features of the invention the inner surface of the central axial opening, which is tapered conically outwardly in a downward direction, is provided with a circumferentially spaced series of axially extending, radially inwardly projecting ribs which serve to enhance the rotational acceleration of fuel present in the opening during turbine spin-up. Additionally, adjacent the upper end of the central axial opening an annular, radially inwardly directed sharp-edged projection is formed to create an annular wiping seal between the upper rotor and the fuel tube received in its central opening, this sharp-edged wiping seal also functions as a bearing to stabilize the upper rotor section on the fuel tube, particularly when the lower portion of the rotor is supported by a ball and race type bearing.

When pressed together as previously described, the upper and lower rotor sections define in the assembled rotor an upper annular fuel passage which communicates with a radially outer fuel discharge passage via the orifice means. Rotational movement of fuel in this upper annular passage relative to the rotor during turbine spin-down is impeded by means of a blocking member extending downwardly from the upper turbine section into such annular passage and positioned slightly upstream of the orifice means relative to the rotational direction of the rotor. Directly beneath this blocking member, and circumferentially spanning the orifice means, is a small bypass channel which connects the blocked upper annular passage at opposite ends of the blocking member and permits fuel to bypass both the blocking member and the orifice (in the rotational direction of the rotor) during turbine spin-down. This small channel, which is directly adjacent the orifice means, also functions as a fuel reservoir positioned immediately adjacent and communicating with the orifice means. The fuel reservoir serves to substantially instantaneously provide fuel outflow through the orifice means during turbine spin-up, thereby reducing the previously discussed fuel supply delay to such orifice means during turbine spin-up.

The upper and lower rotor sections have formed thereon axially extending central cylindrical bosses which are rotatably supportable on upper and lower bearing structures of the housing forming the carburetor throat. To significantly reduce the turbine spin-down time, these bosses, and the overall dimensions of the rotor body, are configured to permit a limited degree of free axial motion as axial "play" between the turbine rotor and these upper and lower supporting structures. During downward ingestion of engine air across the turbine blades, the turbine rotor is subjected to a net downward force. However, upon cessation of such air flow, the still-spinning turbine blades aerodynamically create an upward force which tends to lift the rotor. To shorten the rotational deceleration time of the rotor during spin-down, an upper surface portion thereof is configured and positioned to frictionally engage a facing portion of the upper supporting structure. This frictional interaction between the rotor and its upper support structure functions as a drag brake mechanism to reduce the rotor spin-down time.

DETAILED DESCRIPTION

Figure 1:
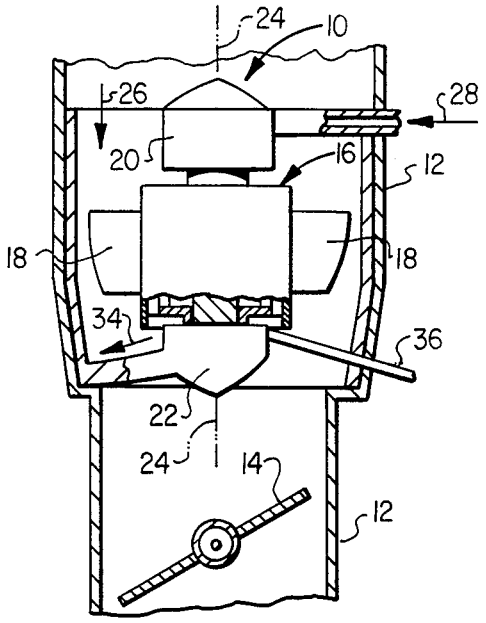
FIG. 1 is a simplified, longitudinally extending view, partially in elevation and partially in cross-section, through a rotor-type carburetor into which is incorporated an improved turbine rotor assembly embodying concepts of the present inention.

Illustrated in somewhat simplified form in FIG. 1 is a rotor-type carburetor 10 which is operatively positioned in an upper end portion of an air intake pipe 12 of an internal combustion engine (not shown). Positioned below carburetor 10 in the intake pipe is a conventional butterfly valve 14. Carburetor 10 includes a generally cylindrical turbine rotor assembly 16, having a circumferentially spaced array of turbine blades 18 disposed in a cylindrically shaped barrel 19 through which induction air to the engine passes. The rotor 26 is rotatably supported on bearings carried by upper and lower support spyders 20, 22 for high speed rotation about axis 24.

During operation of the internal combustion engine, ambient air 26 is drawn downwardly through the throat of the barrel across the turbine blades 18, causing high speed rotation of the rotor 16. Such rotation, via centrifugal fuel pump means formed within the rotor 16 (not shown in fig. 1), causes fuel 28 to be drawn from a source thereof into a fuel inlet passage 30 formed through the upper supporting spyder 20. The fuel is then drawn into the rotor assembly 16 via a downwardly extending, rigidly fixed fuel supply tube 32 (see FIG. 2). Within the rotor assembly 16 the delivered fuel is then properly dosed to provide the correct fuel air mixture, then converted to a fine mist or "fog" 34 which is outwardly dispersed into the intake pipe 12 for mixture with the ingested airstream 26.

The result of this generally described operation of the carburetor 10 is that a constant fuel-air ratio is maintained for all flow quantities of the ingested air 26. This constant fuel-air ratio is automatically enriched during certain operating conditions of the engine by means of a fuel injection tube 36 which selectively supplies additional fuel into the rotor assembly 16 from an external automatic fuel injection system (not shown).

A more detailed description of the operation of carburetor 10 may be found in U.S. patent application Ser. No. 877,445 filed on June 30, 1986 and entitled "Fuel-Air Ratio (————) Correcting Apparatus For A Rotor-Type Carburetor For Internal Combustion Engines". Such application, of which the present application is a continuation-in-part, is hereby incorporated by reference herein.

The present invention provides the rotor assembly 16 with significantly improved structural and operational characteristics which will now be described with initial reference to FIG. 2. Before describing the various details of the improved rotor assembly 16, however, its marked simplicity should be noted and emphasized. It consists primarily of only two relatively simple injection molded parts, a generally cylindrical upper section 50, upon which the array of blades 18 is integrally formed, and a generally cylindrical lower section 52. Upper section 50 has an upwardly projecting axially disposed support boss 54 which is circumscribed by an annular upper surface 56 of section 50. Extending downwardly through the upper end of boss 54 is a central axial opening 58 which continues through the bottom end 60 os a downwardly extending, conically downwardly tapered boss portion 62 of the section 50 (see also FIG. 3). Boss 62 defines with a lower, annular outer wall portion 64 of section 50 an annular, upwardly extending recess formed in section 60 and opening outwardly through its lower end 68.

The lower section 52 has formed through its upper end portion 70 a conically tapered central recess 72 having a slope substantially identical to that of boss 62 but being of a slightly larger diameter along its length. Recess 72 defines in the lower section 52 an annular upper end portion 74 which is generally complementarily configured relative to the annular recess 66 of section 50, but has a slightly smaller cross sectional width as may be seen in FIG. 2. Extending downwardly from the bottom end 78 of the lower section 52 is a central cylindrical support boss 80.

Figure 3:
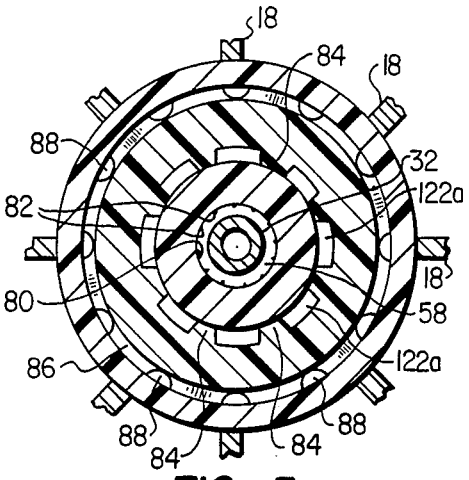
FIG. 3 is a cross-sectional view through the turbine rotor taken along line 3—3 of FIG. 2.
Figure 2:
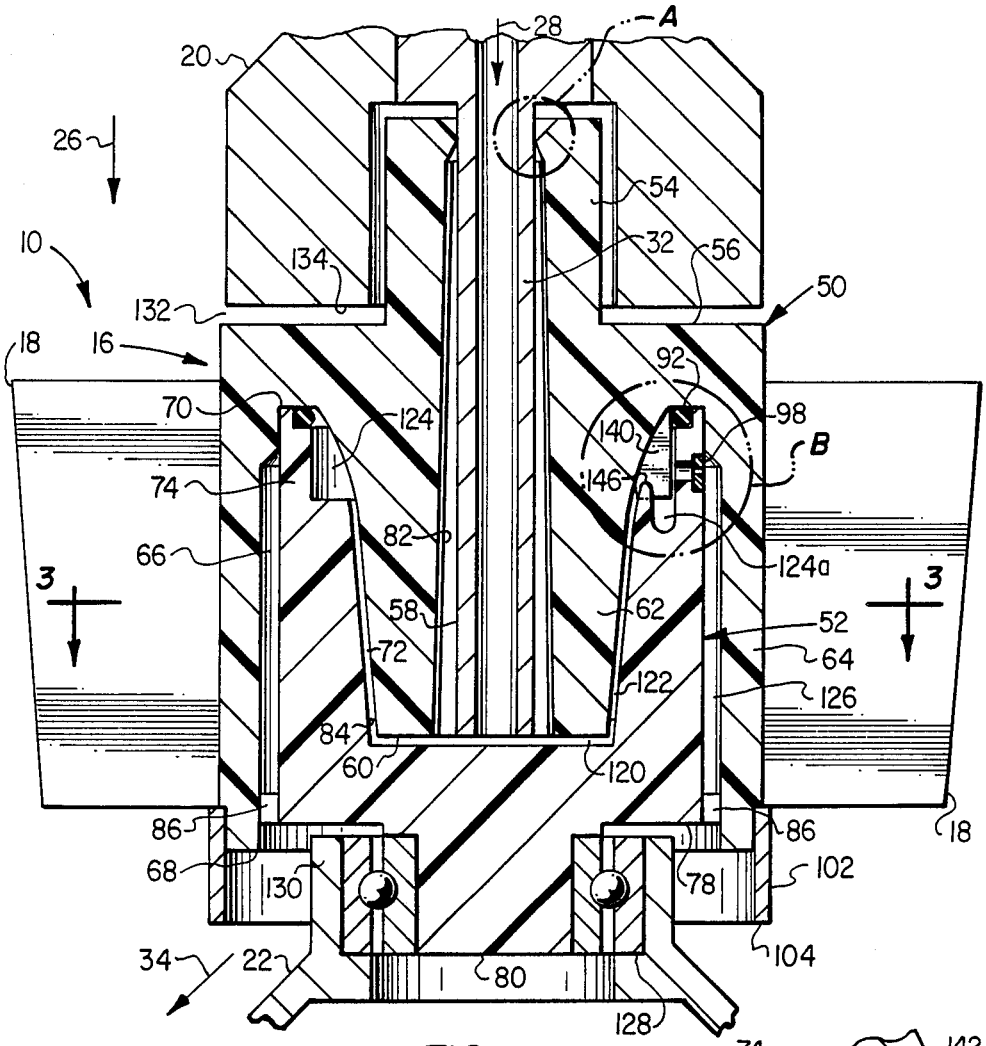
FIG. 2 is an enlarged scale cross-sectional view taken through the turbine rotor and portions of its rotational supporting structure.

Referring now to FIGS. 2 and 3, the inner surface of the downwardly and outwardly conically tapered vertical passage 58 has formed thereon a circumferentially spaced series of small, axially extending ribs 82 which project radially outwardly and downwardly within the annular space 58. In a similar manner, the upwardly and outwardly extending surface of the tapered central surface 72 has formed thereon a circumferentially spaced series of axially extending, radially inwardly projecting ribs 84 (see FIG. 3). At the bottom end 78 of the lower section 52 an outwardly directed circumferential flange 86 is formed, the flange having formed therethrough a circumferentially spaced array of small slots 88. Flange 86 circumferentially engages wall portion 64 adjacent its lower end 68.

Figure 5:
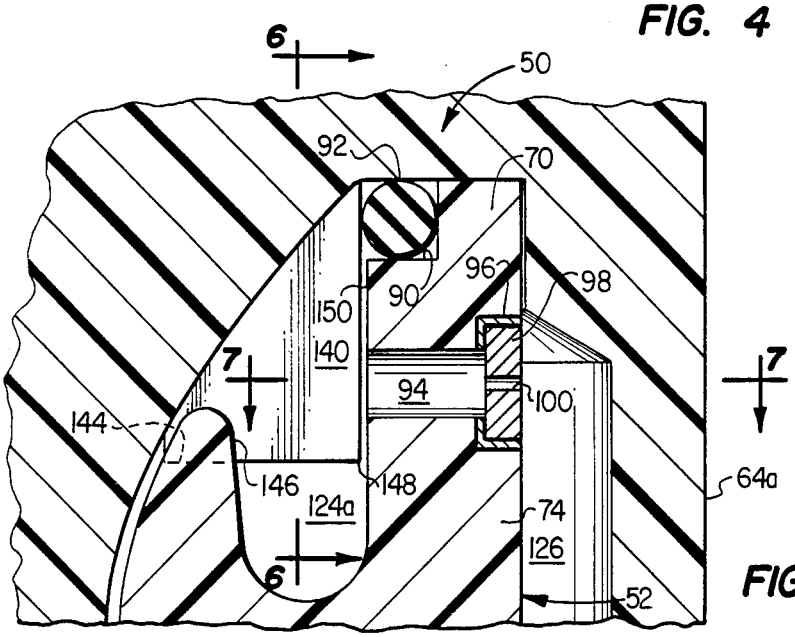
FIG. 5 is an enlargement of the dashed, circled area "B" in FIG. 2.

As may best be seen in FIG. 5, at the upper end 70 of the annular portion 74 of section 52 there is formed an annular notch 90 which operatively receives an elastomeric O-ring 92. Extending radially outwardly through the annular portion 74, beneath the notch 90, is a small transfer passage 94 which has operatively secured at its radially outer end, as by an adhesive material 96, a small orifice member 98 having a very small central opening 100 formed therethrough. Referring again to FIG. 2, a metal spray ring 102, having a sharply squared annular lower end 104, is press-fitted upwardly onto the lower end 68 of the upper plastic section 50 immediately beneath the turbine blades 18.

Assembly of the improved turbine rotor structure 16 is extremely simple. All that is required is to push the annular portion 74 of the lower section 52 upwardly into the annular recess 66 of the upper section 50 until the upper end 70 of the annular portion 74 bottoms out against the upper end of the annular recess 66. The simple pushing together of the two plastic sections 50, 52 automatically forms a single circumferential seal within the turbine rotor structure between its two sections by means of the O-ring 92. If desired, this single interior circumferential seal may alternatively be formed by use of a suitable adhesive instead of the O-ring.

This very easy "snap together" assembly method also simultaneously forms the entire internal passageway system which forms the centrifugal fuel pump portion of the carburetor 10. With the rotor section 16 assembled as just described, such passageway system comprises a generally disk-shaped passage 120 positioned beneath and communicating with the central axial passage 58, a frustroconically-shaped passage 122 extending upwardly from the periphery of passage 120, an upper annular passage 124 communicating with the annular upper end of passage 122, and an anular fuel discharge passage 126 which outwardly circumscribes the previously described passages and communicates with the upper annular passage 124 via the orifice means defined by the transfer passage 94 and the orifice member 98, which is preferable a synthetic ruby with a hole of precisely controlled diameter.

It should be noted that the ribs 84 divide the sloped annular passage 122 into a circumferentially spaced series of subpassages $122_a$which intercommunicate the lower disk-shaped passage 120 with the upper annular passage 124. These ribs 84 also serve to properly align the upper and lower rotor sections 50, 52 during the previously described "push together" assembly thereof. Since it is desirable to minimize the quantity of fuel in the rotor for various reasons, including, reduction of the rotating mass to improve response to changes in air flow, the number and sizes of passages can be minimized as desired.

Figure 4:
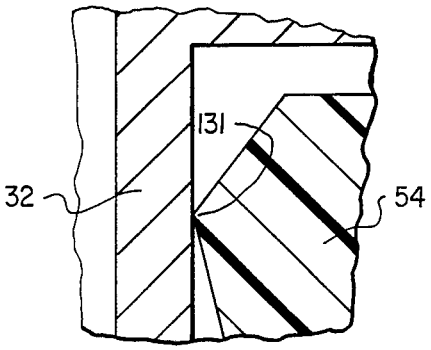
FIG. 4 is an enlargement of the dashed, circled area "A" in FIG. 2.

The assembled turbine rotor section 16 is rotatably carried between the upper support structure 20 (which, in this embodiment of the present invention, also includes the downwardly extending fuel supply tube 32) and the lower support structure 22 in the following manner. The lower support boss 80 is inserted downwardly into the inner race portion of a conventional ball bearing 128 whose outer race is press-fitted into an upwardly projecting annular flange portion 130 of the lower support structure 22. The upper rotor section 50 is rotatably supported by the fuel supply tube 32 which is inserted downwardly into the tapered central opening 58 until the lower tube end is generally level with the bottom end 60 of the boss 62. Adjacent the upper end of opening 58 the inner surface thereof has formed thereon a sharp-edged, annular, inwardly directed portion 132 (FIG. 4) which forms an annular, wiping seal between the upper rotor section 50 and the supply tube 32 and also forms a stabilizing bearing for the upper end of the rotor assembly. It is important to note that all annular surfaces of the two cylindrical sections are at least slightly tapered to provide adequate draft to allow the section to be removed from the injection mold. Only the bore in which the orifice is mounted requires any complexity in the molding process and this, if desired, can be bored after the molding of the part.

During operation of the carburetor 10, the rapidly rotating rotor section 16 draws fuel 28 downwardly through the fuel supply tube 30 into the lower disk-shaped passage 120, centrifugally forces the fuel upwardly into the annular passage 124 via the sloped annular passage 122 and forces it outwardly through the orifice 98 into the annular fuel discharge passage 126. From the fuel discharge passage 126 the fuel is forced downwardly through the flange openings 88 and exits the lower rotor section 52. The exiting fuel is driven across the sharply squared annular lower end 104 of the spray ring 102 to form the fine fuel mist 34 which mixes with the ingested airstream 26. During spin-up of the turbine rotor section 16, the ribs 82 in the central passage 58 serve to enhance the necessary rotational acceleration of residual fuel entrained in a lower portion of passage 58.

According to another aspect of the present invention, the improved turbine rotor apparatus 16 is configured and positioned to uniquely cause it to frictionally engage the upper support structure 20 during turbine spin-down to thereby significantly diminish the turbine's spin-down time. This advantageous effect is achieved in the present invention by configuring the rotor 16 so that a limited degree of axial play thereof between the upper and lower supporting structures 20, 22 is possible, and mounting the rotor structure between such supporting structures so that such axial play is permitted. Specifically, this result is achieved by configuring the lower support boss 80 so that it may axially slide relative to the inner race portion of bearing 128, axially dimensioning the assembled rotor structure 16 relative to the vertical space between the support structures 20, 22 to permit such limited axial play, and by the use of the circumferential sharp-edged wiping seal 131 which permits the assembly 16 to slide upwardly and downwardly along the fuel supply tube 32.

During engine operation, the downwardly ingested air 26 flowing across the turbine blades 18 creates on the rotor assembly 16 a net downward force which causes an annular gap 132 to be created between the annular upper surface 56 of the upper section 50 and the lower surface 134 of the upper support structure 20.

When the air flow 26 ceases, and a rapid turbine spin-down is desired, the aerodynamic force of the still-spinning turbine blades 18 causes the turbine rotor section 16 to lift. Such lifting of the turbine section 16 brings the annular surface 56 into frictional engagement with the support structure surface 134, thereby more rapidly rotationally decelerating the assembly 16. It is important to note that this "drag brake" effect is eliminated during downward flow of air 26, thereby automatically maintaining the annular gap 132 during driven rotation of the turbine rotor. The light weight of the rotor provided by using light weight plastics and minimum liquid volume in the rotating mass, enhances this reaction, which can be further enhanced by eliminating all excess material from the components.

Referring now to FIGS. 2, 5, 6 and 7, a small liquid diverting or blocking member 140 is formed integrally with the upper turbine rotor section 50 and projects downwardly into the upper annular passage 124. Member 140 blocks a very substantial radial portion of the passage 124, (as may best be seen in FIGS. 5 and 7) but extends along only a very small circumferential portion thereof. The blocking member 140 is held in a position immediately upstream of the orifice 98 (relative to the rotational direction 142 of the turbine rotor) by means of a small notch 144 formed in an upturned, circumferential lip portion 146 of the annular portion 74 of lower section 52. Lip 146 defines the radially inner boundary of an axially depressed circumferential portion $124_a$ of the annular passage 124. Passage portion $124_a$ dips beneath both the blocking member 140 and the orifice 98, and extends circumferentially beyond these two elements, as may be best seen in FIG. 6. A small radial gap 148 is left between the blocking member 140 and the radially outer periphery 150 of the annular passage 124 to facilitate assembly.

During normal ingested air-driven rotation of the turbine rotor 16, the annular passage 124 is completely filled with fuel, the portions of the annular passage 124 on opposite sides of the blocking member 140 intercommunicating via the gap 148 and the depressed passage portion $124_a$. Upon turbine deceleration, the inertia of the fuel causes the fuel to flow past the member 140 and is deflected by the passage 124, this tending to both reduce the pressure of the fuel at the orifice and starve the orifice of fuel.

Figure 6:
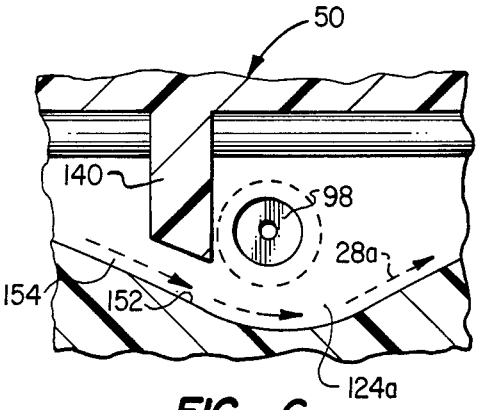
FIG. 6 is a reduced scale cross-sectional view through the turbine rotor taken along the line 6—6 in FIG. 5.
Figure 7:
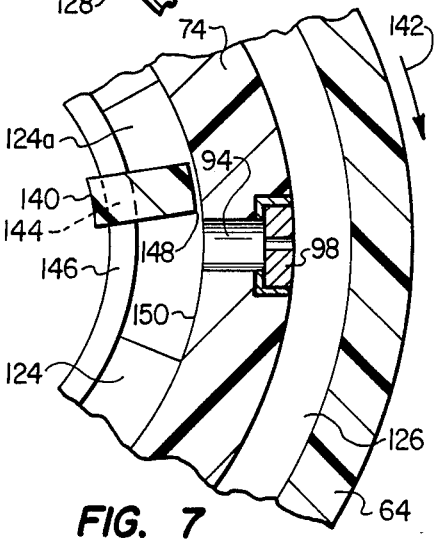
FIG. 7 is a reduced scale cross-sectional view taken through the turbine rotor along line 7—7 in FIG. 5.

More specifically, and as illustrated in FIG. 6, the downwardly projecting blocking member 140 cooperates with the lower surface 152 of passage portion $124_a$ to define a fuel bypass passage 154 positioned beneath and slightly upstream of the orifice. As illustrated by the elongated, dashed arrow $28_a$ in FIG. 6, such passage 154 diverts any circumferentially flowing residual fuel downwardly away from and circumferentially past the orifice 98. This feature significantly diminishes the likelihood of undesirable fuel outflow through the orifice 98 during turbine deceleration as a result of a closing of the throttle valve.

The depressed passage portion $124_a$ also functions to retain a small quantity of residual fuel therein after the completion of turbine spin-down. This creates a small fuel reservoir immediately adjacent the orifice 98 prior to the initial spin-up of the turbine rotor. Upon such spin-up, the residual fuel in such reservoir is ideally placed to provide a more immediate fuel outflow through the orifice. The configuration of the element 140 tends to capture fuel and accelerate the fuel immediately during acceleration of the rotor to insure a complete and immediate supply of fuel at the desired fuel centrifugally induced pressure, thus insuring adequate fuel during acceleration.

It should be noted, that while the two body sections 50, 52 have each been illustrated as being formed from single plastic moldings, they each could be formed from separate sub-sections or members which are joined to define the two sections. For example, the upper body section 50 could be formed from two separate members-one member being the boss 62, the other member being the cylindrical outer wall portion or skirt 64, the two members being joined adjacent the upper end of skirt 64.

Cross-sectionally illustrated in FIG..8 is an alternate embodiment $16_a$ of the turbine rotor assembly 16. With the important exceptions noted below, assembly $16_a$ is similar in construction and operation to assembly 16, with the reference numerals of the components and passages of assembly $16_a$ being given the subscript "a" (or being primed) for ease in comparison with their counterparts in assembly 16 depicted in FIG. 2.

Like the turbine rotor 16, the turbine rotor $16_a$ includes upper and lower injection molded sections $50_a$, $52_a$ which are simply pressed together to form the body of the rotor and simultaneously form the single circumferential seal between the two sections (by means of the O-ring $92_a$) the internal centrifugal pump means, and the feature. However, the turbine rotor $16_a$ further includes a third injection molded plastic section 160 which is frictionally mounted in sealing relationship on the fuel inlet tube $32_a$ between the upper and lower sections $50_a$, $52_a$ thereof. Section 160 may be frustroconically shaped and has a central axial bore 162 extending therethrough, the upper and lower ends of the bore having annular chamfers thereon as indicated by references numerals 164, 166, and is positioned, base-down, at the bottom of the tapered central recess $72_a$ in the bottom section $52_a$ to facilitate assembly as hereafter described. The base of section 160 is positioned just slightly above the bottom of recess $72_a$(thereby forming the upper boundary of the lower disk-shaped passage $120_a$) by means of the fuel tube $32_a$ which has a lower end portion press-fitted into the axial bore 162 of section 160.

Figure 8:
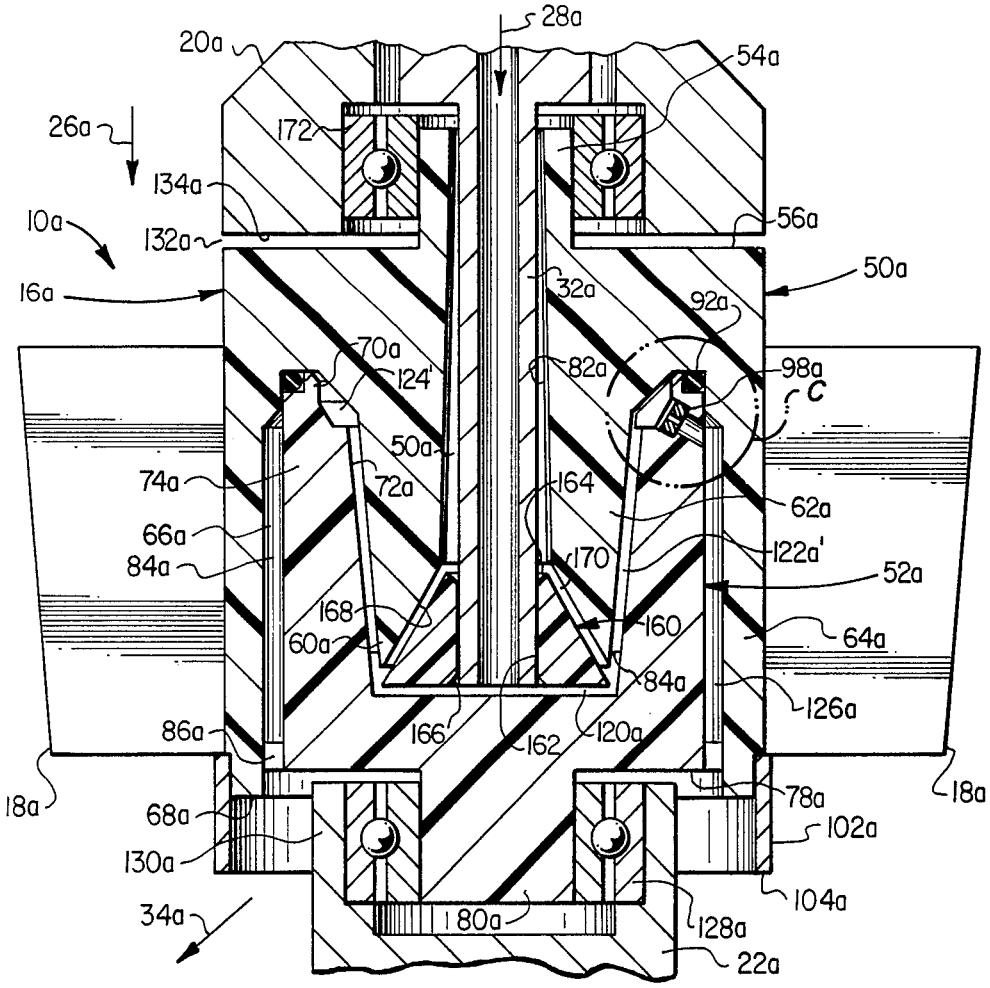
FIG. 8 is a cross-sectional view taken through an alternate embodiment of the turbine rotor.

As illustrated in FIG. 8, section 160 extends upwardly into a frustroconically shaped axial recess 168 formed in the lower end of the downwardly extending central boss $62_a$ of section $50_a$, such boss $62_a$ being somewhat shorter than its counterpart 62 in FIG. 2. The surface of recess 168 is spaced slightly outwardly of section 160 thereby defining therwith a generally frustroconically shaped passage 170 which communicates at its upper end with the central axial opening $58_a$, and at its lower end with the passage $120_a$ and the sloped, upwardly extending passages $122'_a$.

It should be noted that the addition to the turbine rotor $16_a$ of the third section 160 creates within the rotor a fluid passageway which is vented to the airstream above the rotor which intersects the fuel flow path at a point radially spaced from the axis of rotation by a significant distance and at a point near the bottom of the fuel chamber formed within the rotor.

This assures that a significant pressure exists at all times during rotation of the rotor to prevent the ingestion of air into the fuel while also assuring that no fuel can pass upwardly and out the top of the top section. Also, when the rotor is at rest, the fuel standing in the bottom of the rotor insures that no air can enter the fuel chamber.

The assembly of the turbine rotor $16_a$, compared to the assembly or rotor 16, requires only that the third section 160 be placed base-down into the central recess $72_a$. The upper and lower sections $50_a$ and $52_a$ are then pressed together as previously described. When the upper section $50_a$ is pushed onto the fuel supply tube $32_a$, the supply tube is forced into the central opening $58_a$, with the upper chamfer 164 serving to properly guide the fuel tube into the bore 162. When the lower bearing $128_a$ of the lower support spyder $22_a$ is then positioned around the boss $80_a$, the rotor will lower to the appropriate position with section 160 properly positioned between the upper and lower cylindrical sections.

In the embodiment $16_a$ of the turbine rotor assembly, the annular, sharp-edged seal 132 (FIG. 4) is eliminated from the inner surface of the central axial opening $58_a$ extending downwardly through the upper support boss $54_a$. Support boss $54_a$ is thus not rotatably and axially slidably carried by the fuel supply tube $32_a$, but is instead carried by the inner race of an upper ball bearing 172 which is operatively secured to the upper support structure $20_a$.

Figure 9:
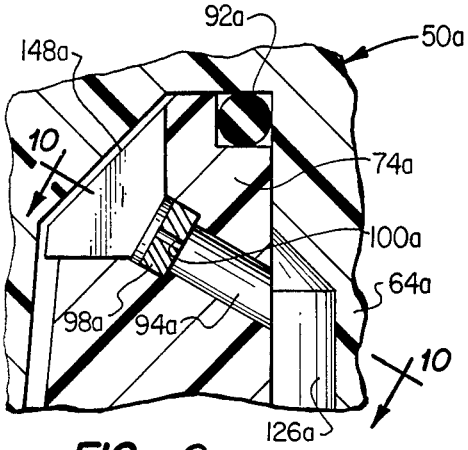
FIG. 9 is an enlargement of the dashed, circled area "C" in FIG. 8.
Figure 10:
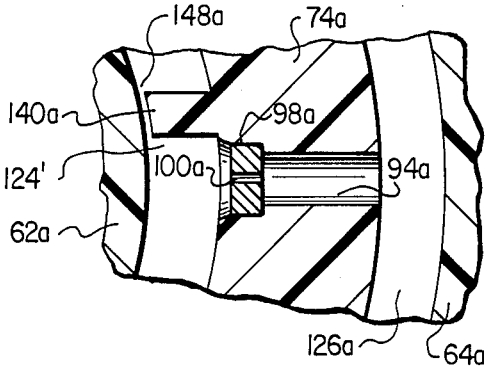
FIG. 10 is a cross-sectional view through a portion of the alternate embodiment turbine rotor taken along line 10—10 of FIG. 9.

Referring now to FIGS. 8, 9 and 10, as in the case of turbine rotor assembly 16, the assembly $16_a$ is provided with a small blocking member $140_a$ which functions (with the exception of a small radial gap $148_a$) to almost completely block the upper annular channel 140' immediately upstream of the orifice $98_a$. However, instead of extending downwardly into such passagae 124', the blocking member $140_a$ is formed integrally with the annular upper end portion $74_a$ of the lower rotor section $52_a$ and projects radially inwardly therefrom into the passage 124'. Additionally, the bypass passage portion $124_a$ and the upturned lip 146 of FIG. 5 are eliminated in the embodiment $16_a$ of the turbine rotor assembly. The blocking member $140_a$ thus essentially completely blocks the annular passage 124' to thereby preclude any appreciable amount of fuel from circumferentially reaching the orifice $98_a$ during turbine deceleration.

It can be seen from the foregoing that the present invention provides a turbine rotor assembly that is significantly improved and simplified relative to previously proposed turbine rotor designs. Additionally, the construction of the improved assembly is substantially simplified, thereby reducing the overall cost of the finished product.

The foregoing detailed description is to be clearly understood as given by way of illustration and example only, the spirit and scope of this invention being limited solely by the appended claims.

What is claimed is:

1. A rotor-type carburetor comprising:

a first generally cylindrical rotor section having an anular recess extending axially inwardly from one end portion thereof;

a second generally cylindrical rotor section having an annular end portion complementarily received in said annular recess of said first rotor section;

means defining a circumferential seal between said first and second rotor sections within said annular recess of said first rotor section; and wherein said annular end portion has an upper end, and wherein said seal-defining means include an O-ring carried by said upper end.

2. A rotor-type carburetor comprising:

a first generally cylindrical rotor section having an annular recess extending axially inwardly from one end portion thereof;

a second generally cylindrical rotor section having an annular end portion complementarily received in said annular recess of said first rotor section;

means defining a circumferential seal between said first and second rotor sections within said annular recess of said first rotor section; and wherein said first rotor section has an upper end portion having formed therethrough an axially extending central passage adapted for installation therein of a fuel supply tube, the interior surface of said axially extending central passage having formed thereon a radially inwardly projecting sharp-edged annular portion configured to sealingly engage the inserted fuel supply tube.

3. A rotor-type carburetor comprising:

a first generally cylindrical rotor section having an annular recess extending axially inwardly from one end portion thereof;

a second generally cylindrical rotor section having an annular end portion complementarily received in said annular recess of said first rotor section;

means defining a circumferential seal between said first and second rotor sections within said annular recess of said first rotor section; and wherein said first rotor section has a central axial passage extending downwardly through its upper end and adapted to receive a fuel supply tube, said central axial passage being conically outwardly flared in a downward direction, and wherein said first and second rotor sections define within said rotor apparatus a frustroconically shaped passage having a base portion communicating with the lower end of said central axial opening, an annular side portion which circumscribes said central axial opening and flares conically upwardly from said base portion; an upper annular passage positioned at and communicating with the upper end of said frustoconically shaped annular passage; and an annular fuel discharge passage positioned radially outwardly of said upper annular passage, said apparatus further comprising orifice means intercommunicating said upper annular passage with said annular fuel discharge passage.

4. The apparatus of claim 3 wherein the radially inner surface of said upper annular end portion of said second rotor section has a circumferentially spaced plurality of radially inwardly projecting ribs which divide said annular side portion of said frustroconically shaped annular passage into a plurality of separate passages each intercommunicating said upper annular passage with said base portion of said frustroconically shaped passage.

5. The apparatus of claim 3 wherein said second rotor section has a radially outwardly projecting flange which engages the inner surface of said annular recess of said first rotor section, said flange having a circumferentially spaced series of fuel discharge openings formed therethrough.

6. A rotor-type carburetor comprising:

a first generally cylindrical rotor section having an annular recess extending axially inwardly from one end portion thereof;

a second generally cylindrical rotor section having an annular end portion complementarily received in said annular recess of said first rotor section;

means defining a circumferential seal between said first and second rotor sections within said annular recess of said first rotor section; and wherein said first rotor section has a central axial passage extending downwardly through its upper end, and wherein said apparatus further comprises means associated with the inner surface of said central axial passage for enhancing the rotational acceleration of fuel therein during rotational acceleration of said turbine rotor apparatus.

7. The apparatus of claim 6 wherein said fuel acceleration-enhancement means include at least one axially extending rib projecting radially inwardly from the inner surface of said central axial passage.

8. A rotor-type carburetor comprising:

a first generally cylindrical rotor section having an annular recess extending axially inwardly from one end portion thereof;

a second generally cylindrical rotor section having an annular end portion complementarily received in said annular recess of said first rotor section;

a third rotor section having a generally frustroconical configuration with a central passage formed axially therethrough, said third rotor section being captively retained within said rotor apparatus between said first and second sections thereof and defining with said first and second sections a first frustroconically shaped internal passage in said apparatus which circumscribes the axis thereof.

9. The apparatus of claim 8 wherein said first rotor section has a central axial passage extending downwardly through an upper end portion thereof;

said rotor apparatus further comprises a fuel supply tube extending downwardly through said central axial passage and having a lower end portion press-fitted into said central passage of said third rotor section; and said third rotor section and said frustroconically shaped internal passage each have a side portion which tapers radially inwardly in an upward direction.

10. The apparatus of claim 9 wherein said fisrt and second rotor sections define within said rotor aparatus:

a second frustroconically shaped passage circumscribing said central axial passage, communicating with said first frustroconically shaped passage, and having an upwardly and radially outwardly tapered side portion;

an upper annular passage positioned at and communicating with the upper end of said second frustroconically shaped passage;

and an annular fuel discharge passage positioned radially outwardly of said upper annular passage; and and wherein said rotor apparatus further comprises orifice means intercommunicating said upper annular passage with said annular fuel discharge passage.

11. The apparatus of claim 10 wherein the upper and lower ends of said third rotor section have annular chamfers formed thereon adjacent said central passage extending through said thrid rotor section.

12. A rotor type carburetor comprising:

a first rotor section having a first inlet passageway extending axially therethrough and having a first face;

a second rotor section having a second face disposed adjacent the first face;

annular seal means positioned between the first and second faces to form a centrifugal pressure chamber for fuel to establish a fuel pressure within the chamber proportional to the rotational velocity of the rotor;

dosing orifice means sized to pass a predetermined dose of fuel proportional to the fuel pressure from the chamber for ingestion by an engine;

the first and second faces cooperatively defining the pressure chamber in such a manner that the chamber has a volume substantially less than the total volume of the first and second rotor sections combined.

13. The rotor type carburetor of claim 12 wherein the rotor further includes turbine blades attached to one of the sections whereby the rotor may be disposed in an intake air passageway and rotated by induction air to an engine.

14. The rotor type carburetor of claim 13 wherein:

the rotor is disposed for rotation about a vertical axis with the induction air passing downwardly through the air passageway, the second rotor section is disposed below the first and is supported for rotation by a thrust bearing at the lower end thereof, a stationary fuel inlet tube extends downwardly through the center of the first rotor section to a point adjacent the second face, and the pressure chamber extends from the lower end of the fuel inlet tube upwardly and outwardly to the dosing orifice which is located substantially above the lower end of the inlet tube to permit the establishment by gravity of a fuel level within the rotor equal to a level outside the rotor when the rotor is at rest.

15. The rotor type carburetor of claim 14 wherein the turbine blades are attached to the first rotor section and are largely disposed at a height between the lower end of the inlet tube and the dosing orifice, and said carburetor further comprises:

fuel spray edge means formed on the rotor and disposed below the turbine blades, and fuel passageway means for transporting fuel from the dosing orifice means to the spray edge means.

16. A turbine rotor assembly for a rotor-type carburetor or the like, said turbine rotor assembly being rotatable about an axis and comprising:

(a) means defining a first annular passage positioned within said assembly, circumscribing said axis, and adapted to receive fuel supplied to said assembly during rotation thereof;

(b) means defining a second annular passage positioned within said assembly, circumscribing said axis radially outwardly of said first annular passage and adapted to discharge fuel from said assembly;

(c) orifice means carried within said assembly and intercommunicating said first and second annular passages; and (d) means, positioned in said first annular passage upstream from said orifice means relative to the rotational direction of said assembly, for blocking a substantial radial portion of said first annular passage along a relatively small circumferential portion thereof.

17. The assembly of claim 16 wherein said first annular passage has a circumferential bypass portion extending beneath said blocking means and configured to cause fuel in said first annular passage to bypass said orifice means during rotational deceleration of said turbine rotor assembly.

18. The assembly of claim 17 wherein said turbine rotor assembly includes a first section which carries said blocking means, and a second section, extending into said first section, in which is formed said bypass portion of said first annular passage, said second section having a lip thereon which partially defines said bypass portion, said lip having formed therein a notch which receives a portion of said blocking means to thereby correctly position said blocking means relative to said orifice means.

19. A method of assembling the turbine rotor portion of a rotor-carburetor, comprising the steps of:

(a) providing a first section of the turbine rotor having therein an annular recess;

(b) providing a second section of the turbine rotor having thereon an annular boss;

(c) inserting said annular boss into said annular recess; and (d) forming a circumferential seal within said annular recess between said annular boss and said first turbine rotor section.

20. The method of claim 19 wherein said annular boss has an outer end, and wherein said seal-forming step (d) includes positioning an O-ring on said outer end of said annular boss prior to the performance of said inserting step (c).

21. The method of claim 19 wherein said providing steps (a) and (b) are performed by providing plastic first and second turbine rotor sections.

22. The method of claim 19 wherein said first rotor section has an annular lower end portion, and said method further comprises the step of operatively securing a spray ring to said annular lower end portion.

23. The method of claim 22 wherein said securing step is performed in such a manner that an axial portion of said spray ring extends downwardly beyond said annular lower end portion of said first rotor section when spray ring is secured thereto.

24. A method of assembling the turbine rotor portion of a rotor-carburetor having a centrally disposed fuel supply tube, said method comprising the steps of:

(a) providing a first section of the turbine rotor having an axis, an axially extending internal boss, an annular recess circumscribing said internal boss, and a central opening extending axially through said internal boss;

(b) providing a second section of the turbine rotor having an axis, an annular boss circumscribing said last-mentioned axis and having an interior base portion;

(c) providing a third section of the turbine rotor having a central opening formed therethrough;

(d) inserting said annular boss into said annular recess;

(e) interposing said third section between said internal boss and said interior base portion; and (f) inserting an end portion of the fuel supply tube inwardly through said central opening of said first section and into press-fitting engagement with the surface of said central opening of said third section.

25. The method of claim 24 further comprising the step of forming a circumferential seal within said annular recess between said annular boss and said first turbine rotor section.

26. The method of claim 25 wherein said annular boss has an annular end portion, and wherein said seal-forming step includes operatively positioning an O-ring on said annular end portion prior to the performance of said inserting step (d).

27. A method of rotationally retarding the bladed turbine rotor portion of a rotor-type carburetor upon shut-down of an engine in which the carburetor is installed, the turbine rotor having upper and lower opposite end portions rotatably carried, respectively, by upper and lower support structures, the rotating turbine rotor blades creating a downward force on the rotor during engine operating and a lifting force thereon when air inflow to the engine ceases, said method comprising the steps of:

(a) axially slidably mounting the opposite upper and lower end portions of the turbine rotor, respectively, in the upper and lower support structures;

(b) configuring the turbine rotor to permit axial play thereof between the upper and lower support structures; and (c) providing said turbine rotor with a surface positioned and configured to frictionally engage one of said supporting structures when said turbine rotor lifts during air flow shut-down to the engine.

28. A rotor type carburetor comprising:

a cylindrical barrel forming a passageway of air to be driven into an engine, upper and lower support spiders attached to the cylindrical barrel and extending into the passageway, a fuel inlet tube extending from the upper support spyder toward the lower support spyder along the axis of the passageway and connected to a supply of fuel, a rotor supported by bearing means on the lower spyder for rotation about the fuel inlet tube, the rotor including;

a generally cylindrical first member having an axial bore therethrough for receiving the fuel inlet tube, and a lower face;

a generally cylindrical second member having means on the lower end for cooperative engagement with the bearing means on the lower support spyder for rotatably supporting the rotor for rotation about the axis and an upper face disposed adjacent the lower face of the first member;

an annular seal formed between the first and second member to form a fuel pressure chamber between the adjacent faces communicating with the fuel inlet tube, for establishing fuel pressure upon rotation of the rotor due to centrifugal forces;

a fuel dosing orifice formed in one of the members at a point spaced radially from the axis of the rotation and substantially above the lower end of the fuel inlet tube for providing fluid communication from the fuel pressure chamber to the exterior of the chamber;

the lower and upper faces being conformed to form a fuel passageway within the pressure chamber from the lower end of the fuel inlet tube to the dosing orifice of substantially reduced volume when compared to the total available volume;

a plurality of turbine blades formed on a cylindrical third member disposed around the first and second members;

a circumferential spray edge formed on the lower end of the third member below the turbine blades for atomizing fuel applied thereto as the rotor rotates due to air passing through the barrel and over the turbine blades; and the third member defining a fuel passageway from the dosing orifice to the spray edge.

29. The rotor type carburetor of claim 28 further comprising:

a fourth annular member mounted on the inlet tube and disposed in spaced relationship between the first and second members, the fourth annular member projecting radially outwardly from the fuel inlet tube to extend the passageway formed by the annulus between the tube and the first member outwardly from the tube before communicating with the pressure chamber.

30. The rotor type carburetor of claim 28 wherein:

the first and third members are formed of the same molded component, joined near the upper end of the third component, and the dosing orifice means is a radial passageway through the second member.

31. The rotor type carburetor of claim 28 further characterized by an annular sliding seal rotating with the first member and engaging the fuel inlet tube, the sliding seal having a very small area of contact and being formed by an injection molded plastic.

32. The rotor type carburetor of claim 28 wherein the third annular member includes a metallic tension band disposed around the lower end thereof which also forms the spray edge.

33. The rotor type carburetor of claim 28 wherein the dosing orifice is formed by a synthetic ruby inset secured in a passageway extending through one of said first and second members.

* * * * *

UNITED STATES PATENT AND TRADEMARK OFFICE

CERTIFICATE OF CORRECTION

PATENT NO. : 4,725,385

DATED : February 16, 1988

INVENTOR(S) : Rudolf Diener and Elbert M. Hubbard

It is certified that error appears in the above-identified patent and that said Letters Patent is hereby corrected as shown below:

Col. 1, line 53, "thereby" should be --therefore--.

Col. 2, line 49, "portios" should be --portions--.

Col. 5, line 19, "26" should be --16--.

Col. 5, line 68, "os" should be --of--.

Col. 10, line 67, insert --appreciably-- between "thereby" and "reducing".

Col. 11, line 31, "installation" should be --insertion--.

Col. 12, line 62, "fisrt" should be --first--.

Col. 13, line 14, "thrid" should be --third--.

Signed and Sealed this

Thirtieth Day of August, 1988

*Attest:*

*Attesting Officer*

DONALD J. QUIGG

*Commissioner of Patents and Trademarks*